United States Patent [19]

Niederhauser

[11] 4,071,931

[45] Feb. 7, 1978

[54] WEB FORMING METHOD

[75] Inventor: Donald Olcott Niederhauser, Wilmington, Del.

[73] Assignee: E. I. Du Pont de Nemours and Company, Wilmington, Del.

[21] Appl. No.: 783,455

[22] Filed: Mar. 31, 1977

[51] Int. Cl.[2] ..... D04H 3/04; D04H 3/05

[52] U.S. Cl. ..... 28/101; 156/439

[58] Field of Search ..... 28/100, 101, 102; 156/439; 19/160, 163; 66/84

[56] References Cited

U.S. PATENT DOCUMENTS 4,030,168 6/1977 Cole ..... 28/101

*Primary Examiner*—Louis K. Rimrodt

[57] ABSTRACT

A method of traversing a strand between two spaced rows of strand-restraining elements moving together in the same direction in the same plane to form a web is implemented by a pair of strand-engaging members associated with each row of strand-restraining elements for slideably engaging the strand and moving it in alternate traverses toward one and then the other row while forming a loop in the strand during each tranverse. The second member of the pair of strand-engaging members travels faster than the first and catches up with it as it crosses the row of strand-restraining elements. The loop is brought into a plane parallel to the plane of the rows of strand-restraining elements. Means are provided for disengaging the loop from the strand-engaging members and depositing the loop around the strand-restraining elements as soon as the loop is moved beyond the row of elements.

7 Claims, 6 Drawing Figures

WEB FORMING METHOD

BACKGROUND OF THE INVENTION

This invention relates to traversing a strand or strands to form a restrained cross-laid web. More particularly, it relates to an improved method for traversing a plurality of strands with good precision of laydown at high speed to form a restrained web.

Patent application Ser. No. 718,338 filed Aug. 27, 1976, now U.S. Pat. No. 4,030,168, granted June 21, 1977, of common assignee, discloses a method of traversing a strand between two pin conveyors in a plane transverse to the plane of the conveyors wherein a loop in the strand is formed, turned out of the plane of traverse, and then deposited on the pins of one of the conveyors, after which the strand is traversed in the same way to the other conveyor and the cycle is repeated. In the method described, the strand is slideably engaged by a hook rotating in the plane of traverse and is then also slideably engaged by a spreader rotating in a plane skewed to the plane of the hook. In the embodiments disclosed, the spreader travels closely behind the hook at the same peripheral speed as it moves across the plane of the hook. The hook and the spreader together form a loop in the strand which is traversed across the row of pins on one conveyor and doffed. Since the spreader is traveling slightly behind the hook in the embodiments disclosed, and since the doffing action is not completed until the spreader has crossed the row of pins, a considerable length of srand is contained within the loop beyond the row of pins at the time of doff. Since the loop thus contains considerable slack, it tends to be pulled against the pins with a jerk. The lack of smooth doffing action tends to limit the speed at which the web can be laid down.

SUMMARY OF THE INVENTION

The present invention comprises an improvement in the method described and claimed in U.S. patent application Ser. No. 718,338 for forming a restrained cross-laid web by traversing a strand between two spaced rows of strand-restraining elements moving together in the same direction at the same speed in the same plane.

In the method claimed in the above noted U.S. application, each traverse comprises (1) feeding the strand from a supply to a location out of the plane of the rows of strand-restraining elements and between them, and thence toward one of the rows; (2) engaging the strand between said location and said strand-restraining elements and moving the strand toward the other row of strand-restraining elements in a transverse plane angled to the plane of the strand-restraining elements while simultaneously moving the strand away from said transverse plane to form a loop in the strand; (3) bringing said loop into a plane substantially parallel to the plane of the strand-restraining elements; and (4) depositing said loop on said other row of strand-restraining elements.

In the improved method of the present invention, when the loop is brought into the plane substantially parallel to the plane of the strand-restraining elements, the end of the loop is also brought substantially parallel to the row of strand-restraining elements; and the loop is deposited upon the strand-restraining elements as soon as the end of the loop is moved beyond the row of elements. This is accomplished by rotating the paired strand-engaging members at different peripheral velocities, the first member of the pair engaging the strand first and the second member of the pair traveling at higher velocity than the first member and so positioned with respect to the first member that it catches up with the first member and is substantially in alignment with it at the point of disengagement of the loop from said members.

BRIEF DESCRIPTION OF THE ILLUSTRATED EMBODIMENTS

DETAILED DESCRIPTION OF THE ILLUSTRATED EMBODIMENTS

The apparatus chosen for purposes of illustration is substantially the same as that disclosed in allowed U.S. patent application Ser. No. 718,388 filed Aug. 27, 1976 and includes (1) a strand supply source; (2) a guide located out of the plane of said rows and between them for receiving the strand from said supply source; (3) at least one pair of rotatable strand-engaging members associated with each row of strand-restraining elements for slideably engaging the strand between said guide and said plane and traversing said strand toward one and then the other row while forming a loop in said strand during each traverse and bringing said loop into a plane substantially parallel to the plane of the rows of strand-restraining elements and beyond said rows; and (4) means for disengaging said loop from said strand-engaging members beyond said rows of strand-restraining elements and depositing the strand in a loop around at least one of said elements.

Figure 1:
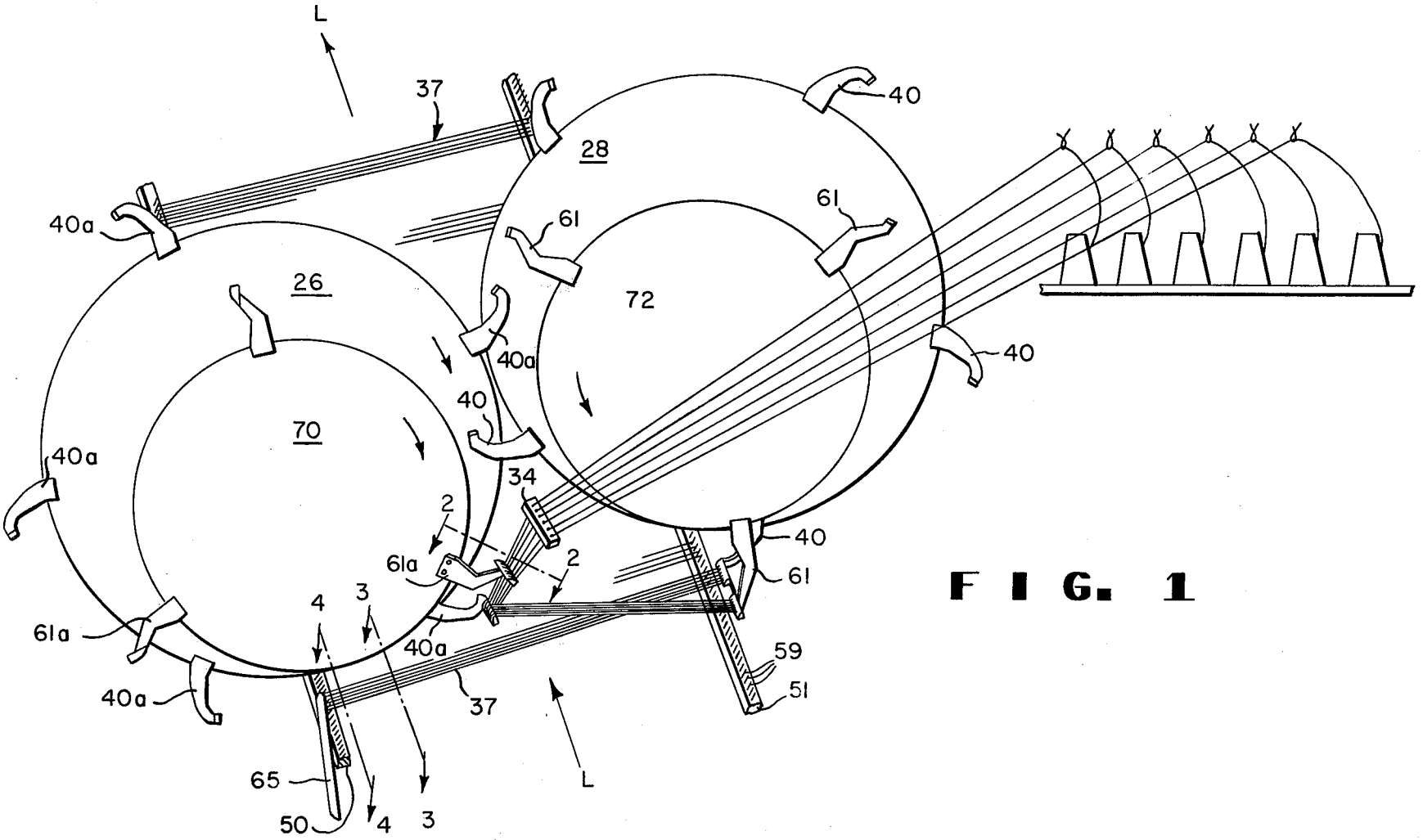
FIG. 1 is a perspective view showing the relationship of hooks and spreaders on the rotating disks of the apparatus for traversing six strands onto a pin conveyor according to the present invention.

More particularly, in FIG. 1 primary disks 26, 28 carry strand hooks 40, 40*a* attached at five equal spacings on their peripheries and extending outward from these disks. Each of the hooks 40 comprises an arm with an end projecting at right angles to the arm and there are slots formed in this end with the same spacing as the eyelets in guide 34. The plane of disk rotation is such as to align the slots with the eyelets in guide 34. The slots may be formed in a number of ways, e.g., by grooving the projecting end of the arm or by inserting pins therein.

Secondary disks 70, 72 carry spreader arms 61, 61*a*, attached at three equal spacings on their peripheries and extending outward from these disks. The secondary disks rotate faster than the primary disks (higher circumferential velocity), but the velocities are coordinated such that hooks and spreaders always pass by guide 34 in the same position relative to each other. The ratio of the diameter of the path of the hooks 40, 40*a* to the diameter of the path of the spreader arms 61, 61*a* in the illustrated embodiment of FIG. 1 is 5:4 and the ratio of the rate of rotation of the secondary disk to the primary disk is 5:3. Each spreader arm 61, 61*a* has fingers extending outward from the arm with spacings between the fingers that match the spacings of the eyelets in guide 34. The path of spreader arm rotation is such that the fingers just clear guide 34 as they pass by. As an example, the interrelationship between the fingers on arms 61*a*, the slots in hooks 40*a*, and the eyelets in guide 34 will be described in more detail later. Mounted below the disks in frame 20 are a pair of endless driven conveyors 50, 51. Both conveyors move together at the same rate of speed in the direction L of the arrows shown. Mounted on the surface of both conveyors are upstanding pins 59 for restraining the strands. The pins in each row are arranged with the spacing required to obtain the desired web pattern, and the conveyors are moved together in such a way that the proper relationship of pins in each conveyor with respect to the other is maintained.

Doff blades 65, 66 are rotatably mounted in vertical planes that are close to but outside the paths of conveyors 50, 51. The blades preferably have notches that match the positions of the slots in hooks 40 as the blades rotate past the hooks. The blades may also have notches that match the positions of the spaces between fingers in spreader arms 61. Synchronization of the blades 65, 66 is such that each blade passes between an arm 61 and conveyor 50 or 51 shortly after arm 61 passes over the conveyor. The blades travel at a higher velocity than the velocity of the arms, the blades preferably being given five to fifteen rotations for each rotation of primary disks 26, 28.

Referring now to FIGS. 2–6, the operation of the hooks 40, 40*a*, the spreader arms 61, 61*a* on the rotating disks along with the endless conveyors 50, 51 and their respective doffing blades 65, 66 provides the means for slideably engaging the strands and traversing them toward one and then the other row of pins 59 on each conveyor. A loop in each strand is formed during each traverse and then the loop is brought into a plane substantially parallel to the plane of the conveyors before being disengaged from the hooks and spreaders and then deposited around pins 59 on the respective conveyors to form an orthogonal web 37 moving in machine direction L. More particularly, FIG. 1 shows six strands 36 being fed from a source of supply to the eyelets of guide 34 located above the plane of the conveyors 50, 51 and each strand is thence led toward and beyond conveyor 51 by the hook 40 on primary disk 28 in a traversing plane which contains its respective eyelet in guide 34 and is transverse to the plane of the conveyors. As the strands are led toward conveyor 51 they are intercepted and slideably engaged by a hook 40*a* on primary disk 26 at a location between conveyor 51 and guide 34 and each strand is thereupon led by a first point of sliding engagement on hook 40*a* through an arc in the traversing plane towards conveyor 50. As the strands are led toward conveyor 50 the fingers of spreader arm 61*a* move down between the strands and across the traversing plane of each strand to intercept each strand in a second point of sliding engagement. This action is caused by mounting the primary and secondary disks so that, in the vicinity of the intersection of the planes of the two disks, the tips of the spreader fingers are farther away from the center of the primary disk than the hooks are. Thus, the strands are led by spreader arm 61*a* still towards conveyor 50 but also away from the traversing plane in a direction opposite the motion of the conveyors through an arc in the skew plane of secondary disk 30, said skew plane intersecting both the traversing plane and the conveyor plane.

Figure 2:
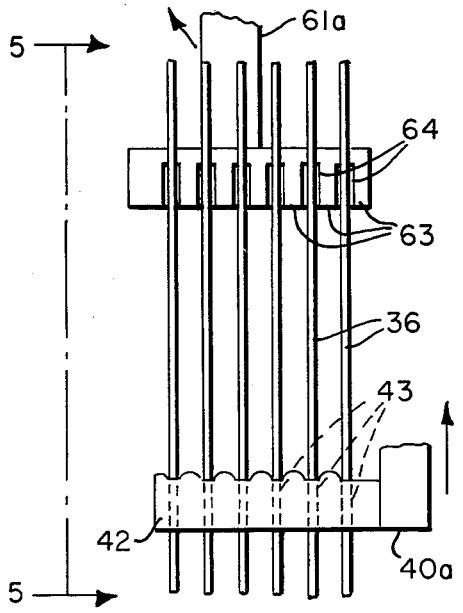
FIG. 2 is a view taken along 2—2 of FIG. 1.
Figure 5:
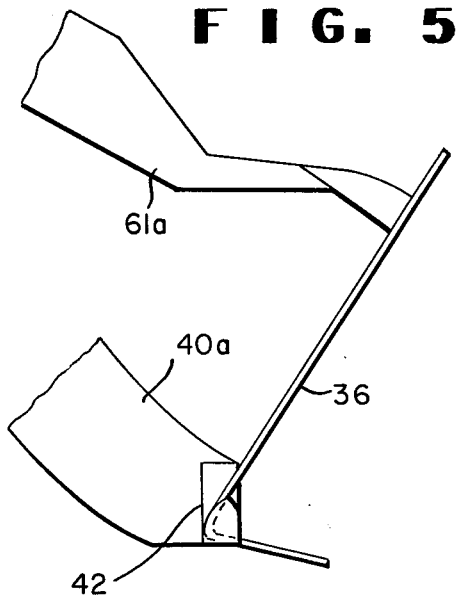
FIG. 5 is a side elevation of FIG. 2 taken along line 5—5.
Figure 3:
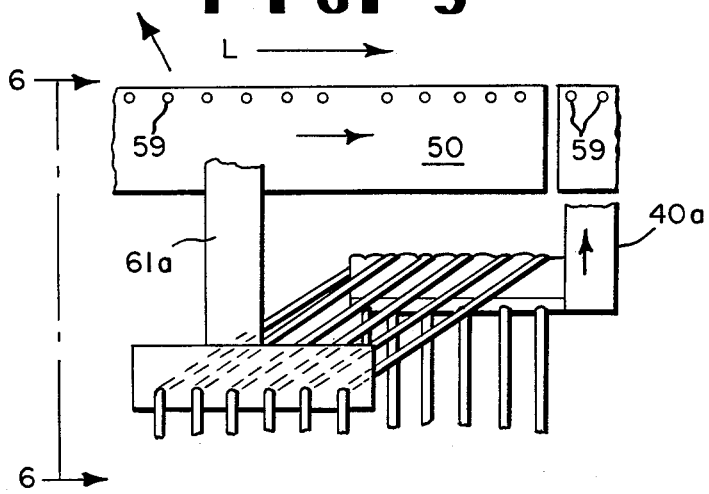
FIG. 3 is a view taken along 3—3 of FIG. 1.
Figure 6:
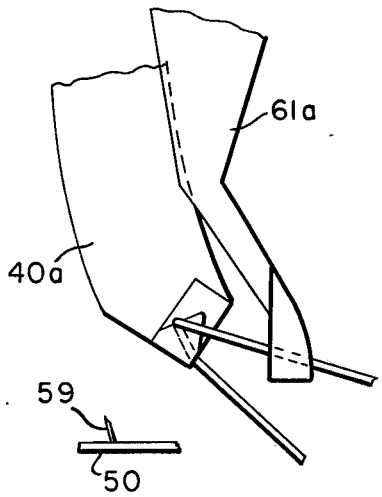
FIG. 6 is a side elevation of FIG. 3 taken along line 6—6.
Figure 4:
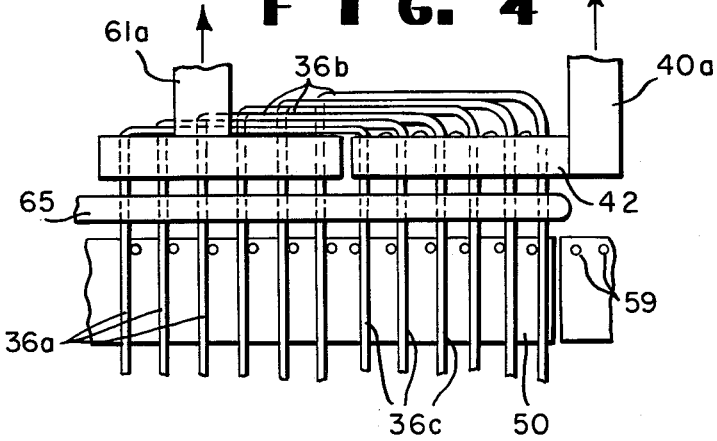
FIG. 4 is a view taken along 4—4 of FIG. 1.

While the strands are being led towards conveyor 50 after being intercepted by hook 40*a* and then spreader arm 61*a*, each strand is formed as an open loop, with one corner of the loop moving in the traversing plane and one corner mmoving in the skew plane. Each loop is led beyond the conveyor 50 whereupon the strands are intercepted by doff blade 65 slideably engaged around the pins 59 of conveyor 50. To show this clearly, locations 2—2, 3—3 and 4—4 on FIG. 1 are presented as enlarged views (FIGS. 2, 3, 4) of the relationship of the strands, hook and spreader during the traverse through those locations. Referring now to FIG. 2, each hook 40*a* has an end 42 projecting at a right angle and there are slots 43 in the end 42 with the same spacing as the eyelet in guide 34 and each spreader arm 61*a* has at its extreme end fingers 63 which extend outward from the arms and also form spacings 64 which match the spacing of the eyelets in guide 34. The fingers 63 have engaged strands 36 and are leading them towards the conveyor 50 but away from the traversing plane. In FIG. 3, taken at location 3—3 of FIG. 1, the open loops are shown being formed and in FIG. 4 this is shown more clearly wherein the strands 36 have been led by two sliding points of engagement, one on each slot of the hook 40*a* and one on each finger of the spreader arm 61*a* in the form of open loops beyond the conveyor 50. Each loop consists of three sections, a side section 36*a* between the hook 40 and the spreader arm 61*a*, an end section 36*b* between the two sliding points of engagement on the spreader arm and the hook and side section 36*c* between the hook 40*a* and conveyor 51. The loop is moved to the conveyor plane by the action of doff blade 65 so that the side sections 36*a* and 36*c* are deposited in intervals between pins 59 on conveyor 50; the end section 36*b* of the loop bridges a designated number of pins. All of the slideable engaging points holding both loops are disengaged from the strands during the deposition of the loops. Inasmuch as the hooks and spreaders are adapted for rotation at different peripheral velocities with the hook 40*a* engaging the strand first and the spreader 61*a* is adapted to travel at a higher velocity than the hook and so positioned that it catches up with the hook and is in substantial alignment with it at the point of disengagement of the loop from the hook and spreader (FIG. 4) the end of the loop 36*b* is brought substantially parallel to the row of strand-restraining elements 59 and the loop defined by sides 36*a* and 36*c* and end 36*b* is deposited upon the strands restraining elements as soon as the end of the loop 36*b* is moved beyond the row of elements. As discussed hereinbefore U.S. patent application Ser. No. 718,338 discloses operation of a somewhat different manner in that the spreader is traveling behind the hook and does not catch up to the hook. Since the doffing action is not completed until the spreader has crossed the row of pins or strand restraining elements 59, a considerable length of strand is contained within the loop beyond the row of pins at the time of doff which results in a rough doffing action that tends to limit the speed at which the web can be laid down. The instant invention considerably reduces the length of strand beyond the row of pins at the time of doff by bringing the end of the loop 36*b* substantially parallel to the row of strand-restraining elements and doffing the loop as soon as the end moves beyond the row of pins. In accordance with the invention the strand is also handled smoothly at the various stages of strands pick-up, loop formation, and doffing of the loop. Web formation proceeds rapidly and uniformly without the loops becoming hung up or the strands otherwise becoming snagged.

What is claimed is:

1. In a method for traversing a strand between two spaced rows of strand-restraining elements moving together in the same direction in the same plane to form a web, each traverse including the steps of feeding the strand from a supply to a location out of the plane of the rows of strand-restraining elements and between them, and thence toward one of the rows, engaging the strand between said location and said strand-restraining elements and moving the strand toward the other row of strand-restraining elements in a transverse plane angled to the plane of the strand-restraining elements while simultaneously moving the strand away from said transverse plane to form a loop in the strand defined by sides and an end, and bringing said loop into a plane substantially parallel to the plane of the strand-restraining elements, the improvement comprising: bringing the end of the loop substantially parallel to said other row and depositing said loop on said other row of strand-restraining elements as soon as the end of the loop moves beyond said other row.

2. The method as defined in claim 1, said strand being engaged by a pair of strand-engaging members rotating at different peripheral velocities, the first member of the pair engaging the strand first and the second member of the pair traveling at higher velocity than the first member and so positioned with respect to the first member that it catches up with the first member and is substantially in alignment with it at the point of disengagement of the loop from said members.

3. The method as defined in claim 1, said transverse plane being orthogonal with respect to said rows.

4. The method as defined in claim 1, said transverse plane being diagonal with respect to said rows.

5. The method as defined in claim 1, said transverse plane being perpendicular to the plane in which the strand-restraining elements are moving.

6. The method as defined in claim 1, said strand being moved toward the other row of strand-restraining elements in an arcuate path.

7. In a method of traversing a strand between two spaced rows of strand-restraining elements moving together in the same direction in the same plane to form a web, wherein said strand is fed from a supply between the rows towards one row and is traversed in a plane transverse to the plane of the strand-restraining elements toward the other row, a loop defined by sides and an end being formed in the strand during each traverse; the improvement comprising: turning the loop out of the plane of traverse into a plane substantially parallel to the plane of the strand-restraining elements while bringing the end of the loop substantially parallel to said other row and then depositing it on said other row of strand-restraining elements as soon as the end of the loop moves beyond said other row.

* * * * *